US008281427B2

(12) United States Patent
Afshar

(10) Patent No.: US 8,281,427 B2
(45) Date of Patent: Oct. 9, 2012

(54) SAFETY SWIMMING POOL DRAIN APPARATUS THAT PREVENTS THE ENTRAPMENT OF A PERSON

(76) Inventor: Reza Afshar, Westlake Village, CA (US)

( * ) Notice: Subject to any disclaimer, the term of this patent is extended or adjusted under 35 U.S.C. 154(b) by 0 days.

(21) Appl. No.: 12/911,130

(22) Filed: Oct. 25, 2010

(65) Prior Publication Data

US 2012/0096635 A1 Apr. 26, 2012

(51) Int. Cl.
*E04H 4/00* (2006.01)

(52) U.S. Cl. ..... 4/507; 4/504; 4/509

(58) Field of Classification Search ..... 4/504, 507, 4/509; 210/163, 459, 460, 167.16
See application file for complete search history.

(56) References Cited

U.S. PATENT DOCUMENTS

| | | | | |
|---|---|---|---|---|
| 5,265,631 | A | 11/1993 | Goettl | |
| 5,878,773 | A * | 3/1999 | Robol | 137/112 |
| 6,230,337 | B1 | 5/2001 | Barnett | |
| 6,295,661 | B1 * | 10/2001 | Bromley | 4/504 |
| 6,687,923 | B2 * | 2/2004 | Dick et al. | 4/504 |
| 6,817,043 | B2 | 11/2004 | Zars | |
| 7,089,607 | B2 | 8/2006 | Barnes et al. | |
| 7,178,179 | B2 | 2/2007 | Barnes | |
| 7,213,275 | B2 | 5/2007 | Goettl | |
| 2010/0050335 | A1 | 3/2010 | Baker | |
| 2010/0068073 | A1 | 3/2010 | Branecky | |

OTHER PUBLICATIONS

Pool Main Drain Safety: Guidance for Complying with the New Federal Law; Washington State Department of Health; Feb. 2009; DOH 333-160.

Single Main Drains: Guidelines fro Regulated Pool Owners, operators, Designers, and Builders; Washington State Department of Health; Dec. 2008; DOH 333-119.

Anti-Entrapment Suction Outlet Cover with Universal Conversion Frame Kit; AquaStar Pool Products; Model #10AVRCFRxxx; Marketing Literature.

Low-Profile Anti-Entrapment Suction Outlet Cover and Skimmer Equalizer Retrofit Kit; AquaStar Pool Products; Model #LP8MHxxx; Marketing Literature.

Retrofit to Square Anti-Entrapment Suction Outlet Cover and Retro-Adapter Frame; AquaStar Pool Products; Model #R1216xxx; Marketing Literature.

Square Retrofit "Wave" Anti-Entrapment Suction Outlet Cover; AquaStar Pool Products; Model #RWAV12xxx; Marketing Literature.

StarGuard Main Drains; Pentair Water Pool and Spa; Model #5001xx; Marketing Literature.

IntelliFlo VS+SVRS; Pentair Water Pool and Spa; p. #6; Marketing Literature of Swimming Pool Pump with an integrated Safety Vacuum Release System (SVRS).

* cited by examiner

*Primary Examiner* — Gregory Huson
*Assistant Examiner* — Erin Deery
(74) *Attorney, Agent, or Firm* — Louis F. Teran

(57) ABSTRACT

The drain apparatus of the present invention is designed and configured to prevent the entrapment of a person by the suction or vacuum forces of a drain in a swimming pool, spa, or any other large body of water with a recirculation system. The drain apparatus of the present invention has a spring biased plunger that immediately closes the drain of a swimming pool, spa, or any other large body of water when a substantial portion of the drain cover is blocked or restricted. By closing the drain, the drain apparatus of the present invention eliminates any vacuum or suction pressure at or underneath the drain cover that entraps a person thus allowing the person to break free easily and immediately without any time delays.

26 Claims, 12 Drawing Sheets

SAFETY SWIMMING POOL DRAIN APPARATUS THAT PREVENTS THE ENTRAPMENT OF A PERSON

BACKGROUND OF INVENTION

1. Field of Invention

The present invention is related to an apparatus and method for preventing the entrapment of a person by the drain of a swimming pool or spa and related injury. More particularly, the invention relates to a drain apparatus for a drain located on the floor of a swimming pool or spa that is coupled to a water recirculation system driven by a pump to extract water from the pool or spa through the drain and pump it back into the pool or spa through various inlets in the wall of the pool. More particularly, the invention relates to a method and apparatus for installing a safety swimming pool drain cover in an existing swimming pool or spa. Additionally, the invention relates to a method and apparatus for installing a safety swimming pool drain cover in new construction of a swimming pool or spa.

2. Description of Prior Art

A swimming pool or simply a pool is a container filled with water intended for swimming or water-based recreation. A swimming pool can be built of various sizes and either above or in the ground. A swimming pool may be for public or private use. Private swimming pools are mostly built in private residences and used for recreation and relaxation by adults, children, and even infants. Public pools are mostly built in hotels, schools, fitness centers, and parks. Public pools are mostly used for fitness, water sports, and training by people of all ages, including elderly and young children.

Swimming pools present a significant risk of death by drowning, especially for young children and the elderly. In regions where private pools are common, drowning is typically a major cause of childhood fatalities. As a result, the design, construction, and maintenance of pools are areas that are highly regulated by federal, state, and local governments.

Swimming pools are designed to be large containers of water with a drain, inlet connections, and a water recirculation system. The water recirculation system is driven by a large water pump that extracts water from the pool through the drain. The water that is extracted from the pool is passed through a debris collection trap and a skimmer to remove large debris such as leaves and branches. The water is then pumped into a large filter to remove other contaminants. Finally the filtered water is pumped back into the swimming pool through the inlet connections that are typically located around the interior wall of the pool.

The drain in a swimming pool creates a significant suction caused by large volume of water being extracted from the pool through the drain by the pump. The suction can be strong enough to trap a person on the drain. When a person inadvertently places parts of their body in the vicinity of an active drain, a portion of their body may become entrapped by the drain. A drain that is completely blocked can develop a strong vacuum within a fraction of a second with suction pressure that may prevent a person entrapped by the drain to be able to break free, thus leading to death by drowning.

A drain in a large swimming pool is generally located at the bottom of the deepest section, may be 6 to 10 feet below the water surface. In smaller pools or spas, the drain is also positioned at the lowest point which may be only a few feet from the surface. Thus in the use of a smaller pool or spa, there is a considerably greater likelihood that the user will come into contact with the drain.

The drains in residential swimming pools are typically 5 to 8 inches in diameter. The recirculation pumps used in pools are typically 0.75 to 2 horsepower pumps that can draw a vacuum as high as 26 inches of mercury. Thus it is possible that the body of a person, when positioned in close proximity to the drain, may be drawn down upon the surface of the drain cover to completely block the drain openings thus creating a strong vacuum that can entrap and drown a person in a few seconds. The suction pressure of this magnitude can prevent young people and some adults from pulling free from the suction of a drain that is completely blocked by the body or clothing of such person. Even if the person is able to pull free, bruises or welts may result. In at least one case, a child was drowned when his abdomen inadvertently covered and blocked the drain, whereby he was entrapped at the bottom of the pool and unable to break free.

Body entrapment typically occurs when a part of a person's torso completely covers a drain. A limb entrapment refers to accidents in which a person's arm or leg is sucked into the drain of a pool. Disembowelment accidents occur where small children place their buttocks over a drain, completely covering the drain creating a seal. Injury occurs when the greatly increased suction acts to eviscerate the child when their lower intestines are sucked out of their body through their anus.

Safety organizations, such as the United States Consumer Product Safety Commission (CPSC), the National Spa and Pool Institute (NPSI), and various governments have acknowledged the need for devices that protect against swimming pool or spa drain entrapment. In fact, in 2008, the Federal Pool and Safety Act became effective and addresses this problem of body entrapment by swimming pool drains.

To address this issue of body entrapment, some of the regulations and standards that have been enacted prohibit single point suction and require at least two drains in fluid communication with one another through a common suction line. When such an arrangement is used, complete blockage of one of the drains will not result in significant pressure differential across the blocked drain as the suction is relieved by flow through the other drains. Thus, removal of a body part from the affected drain is usually possible.

Despite the prohibition of single point suction by construction standards and codes, this restriction is not in effect in all jurisdictions. Even when it is, installers are frequently unaware of the requirement or simply feel that it is not necessary based on their personal experience. Nevertheless, the prohibition of single point suction does not help pre-existing pools since adding a second drain to an in-ground pool is very difficult and very expensive.

In an alternative attempt to prevent suction related injuries in swimming pools, drains have been designed and commercialized with orifices that are geometrically oriented such that total blockage by a human body can be prevented. However, such drains can still cause injury when some of the orifices are covered by debris or other materials and the rest are covered by a human body. In addition, such drains are still susceptible to total blockages by human clothing that can still entrap a human and lead to panic and/or drowning. More importantly, however, such drains are mostly a combination of a drain cover, a drain body, and other components that require is assembly by the installer and are often broken or not properly installed during construction. Such drain covers are taught by U.S. Pat. Nos. 7,178,179; 7,089,607; 6,817,043; and 6,230,337.

In addition, protective safety devices have been developed that can be installed within the pipe of the circulation system to minimize the risk of suction entrapment injury. One such device is an electrical switch that automatically shuts off the circulation pump in the event that vacuum level within the piping reaches a dangerous level. However, if the circulation system of a pool incorporates a check valve, as it most often does, stopping the circulation pump does not always neutralize the vacuum level and free the entrapped person.

Other devices that have been developed for installation within the pipe of the circulation system are mechanically actuated to break the pump suction in the event a high suction condition is sensed due to covering or at least restricting the flow of water through the drain of a pool. Some of these devices introduce air into the inlet side of the pump in response to the sensed high suction condition, which results in loss of pump prime. Other devices provide for a conduit open to the atmosphere that is submerged a given distance below the pool water level and connected to the pump drain to introduce air if a predetermined level of suction is sensed. Many of such devices are very expensive, have many moving parts, and are solutions that can be implemented during the construction of a pool, not a retrofit solution for existing pools. Some of these devices also provide false signals triggered by partially or wholly filled pump and/or skimmer baskets.

Another solution taught by U.S. Pat. Nos. 5,265,631 and 7,213,275 provide for a mechanical fuse that is mounted in the lid of the debris collection trap. Upon the existence of the above average suction force, the lid is vented to permit inflow of any water present above the lid and thereafter ambient the air. The presence of the air within the debris collection trap will cause cessation of any suction pressure at the drain and at any connected skimmer.

Other relief valves have been developed to react to high levels of vacuum within the circulation system of a pool. These relief valves are designed to be installed within the pipe of the circulation system and in fluid communication with the pump. Such valves open by atmospheric pressure overcoming the pressure provided by a spring against a movable plug when the vacuum within the piping increases. Normally the spring holds the plug in the closed position. When the vacuum increases above a safe level the atmospheric pressure overcomes the spring and pushes the plug so as to open the valve to atmosphere.

In addition to the abovementioned devices, many other devices and relief valves have been developed and commercialized for installation within the pipe of the circulation system. The abovementioned devices can be very effective at releasing the suction developed under dangerous circumstances. Unfortunately, they have several technical problems that have limited their use. First, the valves typically need to be plumbed properly into the suction side of the pump. This makes installation difficult for the average homeowner and not conducive to retrofit installations. Second, the valves typically need to be mechanically adjusted for each particular swimming pool. Even if properly adjusted, the valves can be prone to nuisance trips. Third, there is a potential for unauthorized tampering of the devices. Fourth, the pump switch and/or safety device may not be installed properly. Fifth, when the vacuum level approaches the dangerous level, the valve can vacillate between closed and open. Some valves may even repeatedly open partially and reclose, not achieving full actuation unless desired actuation point has been exceed by a substantial margin. Basically the valves may start to activate too early and achieve full activation too late. Thus, the possibility of suction entrapment injury still remains.

Finally, the biggest problem with devices that are installed within the pipe of the recirculation system is the time delay that occurs between the actual entrapment of the person and the actuation of the device. Such time delay is determined by several variables, including the physical distance between the device within the recirculation system and the location of the drain in the pool. Upon blocking or restricting a substantial portion of the drain cover, water will cease to be sucked into the drain and pipe of the recirculation system. Instead, air will get sucked in place of water. Once the air is sucked, substantial vacuum pressure will be created at the drain cover that entraps a person. However, after the person is entrapped, the water already in the drain pipe line will continue to be sucked by the pump followed by the air. Once the air in the pipe line finally reaches the safety device, the vacuum suction will be terminated by the safety device. The time for the air to reach and trigger the safety device can be a few seconds. However, few seconds is sufficient time for the person entrapped by the drain to panic and drown or suffer injury.

Unless these and other practical problems associated with these safety devices used in swimming pools are resolved, the risk of people continuing to be injured or drown by entrapment at the drain of a swimming pool will persist and any effective safety device will fail to be realized.

SUMMARY OF THE INVENTION

Accordingly, the present invention has been made in view of the above-mentioned disadvantages occurring in the prior art. The present invention is a drain apparatus with a spring biased plunger that immediately closes the drain of a swimming pool when a substantial portion of the drain cover is blocked or restricted. By closing the drain, the present invention eliminates any vacuum or suction pressure underneath the drain cover that entraps a person thus allowing said person to break free easily and immediately.

It is therefore a primary object of the present invention to provide a cessation of a suction force underneath the drain cover of a swimming pool if the drain cover becomes blocked or substantially covered.

Another object of the present invention is to provide a cessation of a suction force underneath the drain cover of a swimming pool immediately upon the drain cover becoming blocked or substantially covered by a body part of an occupant of the swimming pool.

Yet another object of the present invention is to reduce the time delay between when the drain cover becomes blocked and when the present invention terminates the resulting suction force to less than a second.

Yet another object of the present invention is to provide an apparatus for releasing a person in a swimming pool captured against the drain of the swimming pool.

A still further object of the present invention is to provide a drain apparatus that is inexpensive and can be installed directly to a typical swimming pool drain without the need of special tools or a professional installer.

A yet further object of the present invention is to provide a drain apparatus that can be used to retrofit the drain in an existing swimming pool and for installation during the construction of a new swimming pool.

The above objects and other features and advantages of the present invention, as well as the structure and operation of various embodiments of the present invention, are described in detail below with reference to the accompanying drawings.

DESCRIPTION OF THE DRAWINGS

The accompanying drawings which are incorporated by reference herein and form part of the specification, illustrate various embodiments of the present invention and, together with the description, further serve to explain the principles of the invention and to enable a person skilled in the pertinent art to make and use the invention. In the drawings, like reference numbers indicate identical or functional similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
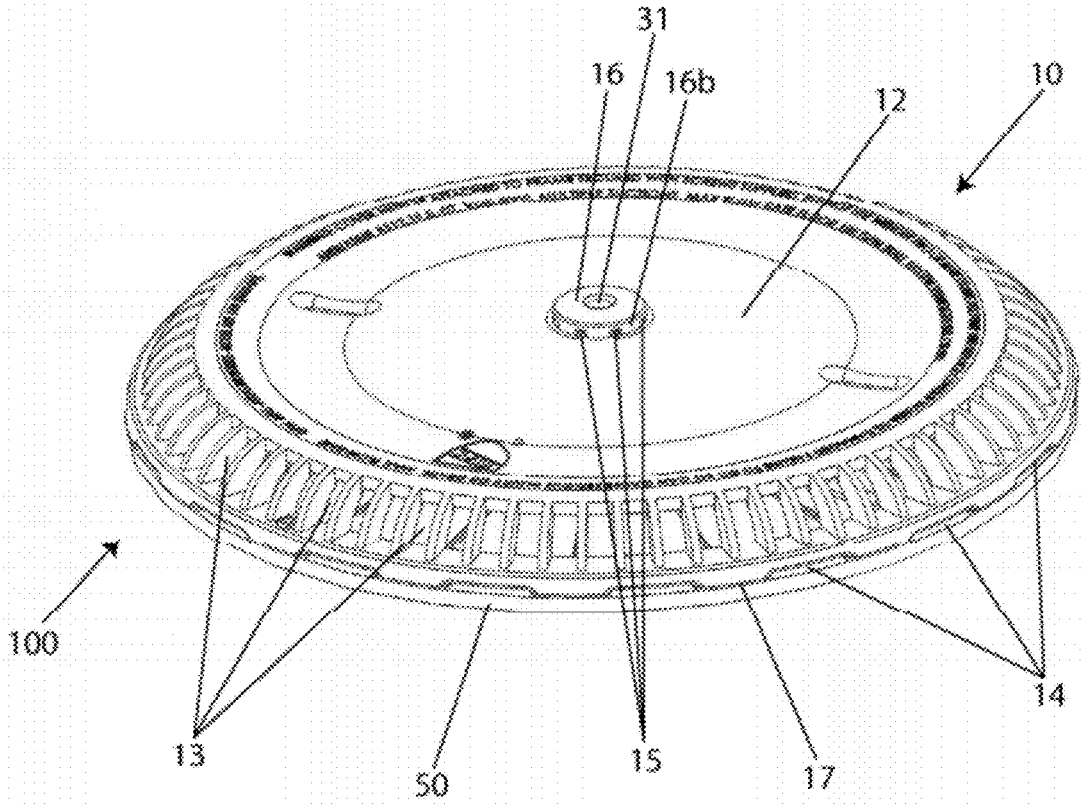
FIG. 1 is a perspective view of the drain apparatus of the present invention in its assembled state as it would be installed on the drainage system of a swimming pool.

Reference will now be made to the drawings in which various elements of the present invention will be given numerical designations and in which the invention will be discussed so as to enable one skilled in the art and make use the invention.

The present invention comprises a drain apparatus 100 with a spring 40 biased plunger 20 that eliminates any suction or vacuum force underneath the drain cover 10 in less than one second after a substantial portion of the drain cover 10 is blocked or restricted. It is well known that a drain in a swimming pool creates significant suction caused by large volumes of water being extracted from the pool through the drain by a suction pump 300. It is also well known that when a typical drain cover in a swimming pool is substantially blocked or restricted, a strong vacuum is developed underneath the drain cover within a fraction of a second with suction pressure that can entrap a person with the inability to break free, thus leading to death by drowning. In the present invention, the vacuum or suction force created when the drain cover 10 is substantially blocked or restricted pulls a plunger 20 down to a bottom position to close the drain orifice 51 that is in fluid communication with the suction pump 300 and located underneath the drain cover 10 so as to eliminate the vacuum or suction pressure underneath the drain cover 10 in less than one second to allow the entrapped person to break free easily and immediately.

Application of the present invention is with drains for swimming pools, spas, jetted tubs, whirlpool baths, hydrotherapy pools, wading pools, water fountains, and any other large container of water used by people and having a water recirculation system driven by a suction pump. However, the preferred embodiment described herein has been configured to meet the needs of a typical residential swimming pool. It will be appreciated by those skilled in the art that the principles of this invention may be applied to other types of pools or large containers of water without departing from the spirit of the present invention.

Figure 2:
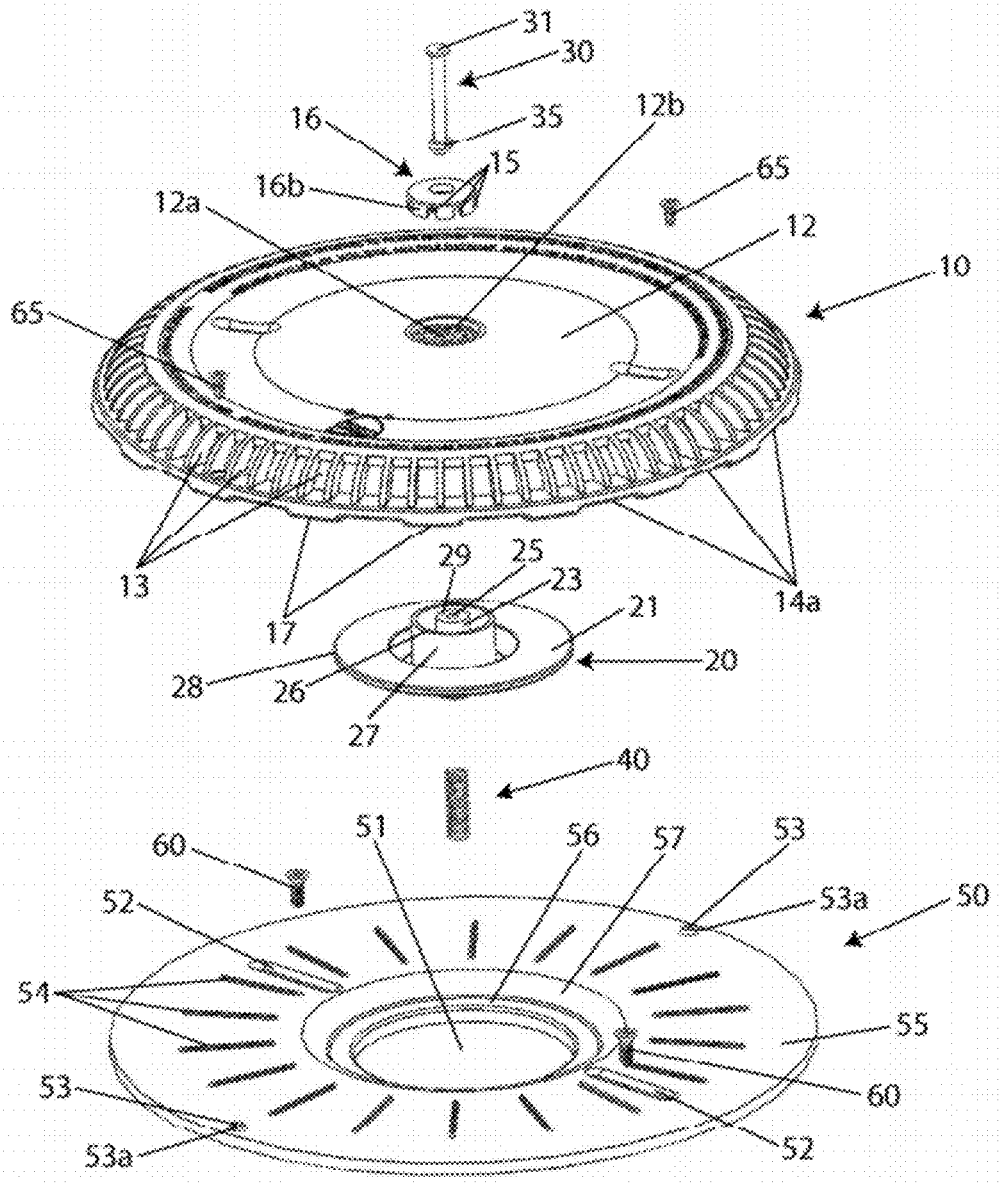
FIG. 2 is an exploded view of the drain apparatus of the present invention.
Figure 7:
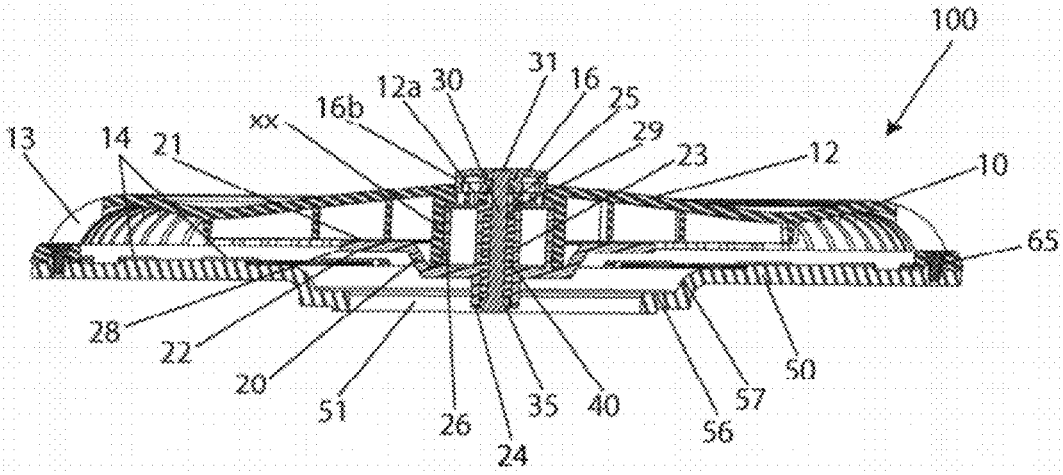
FIG. 7 is a cross sectional view of the plunger assembled to the drain cover with the small bolt, spring, and nut according to the present invention.

FIG. 1 shows a perspective view of the drain apparatus 100 of the present invention in its assembled state as it would be installed on to the drainage system of a swimming pool. FIG. 2 shows an exploded view of the drain apparatus 100 of the present invention to depict in greater detail the various components that comprise the drain apparatus 100. The main component of the present invention is the drain cover 10 which is the most visibly prominent component of the present invention. A plunger 20 is assembled to the bottom face 11 of the drain cover 10 with a joining member 30, a spring 40, and a nut 35. The joining member 30 can be a screw, bolt, shaft, or anything that can hold the spring biased plunger 20 to the drain cover 10. The biasing force generated by the spring 40 pushes the plunger 20 upward to a top position against the bottom face 11 of the drain cover 10. In other words, the spring 40 serves as a biasing means to hold the plunger 20 in the top position underneath the drain cover 10, as shown in FIG. 7. A mounting plate 50 is attached to a wall or floor of the swimming pool and directly over a drain body 200 that is used in typical swimming pools. The drain cover 10 already assembled with the plunger 20 in the top position is then attached to the mounting plate 50. Mounting plate screws 60 are used as means to secure the mounting plate 50 to the wall or floor of the swimming pool and to the drain body 200 while drain cover screws 65 are used as means to secure the drain cover 10 to the mounting plate 50.

Figure 3A:
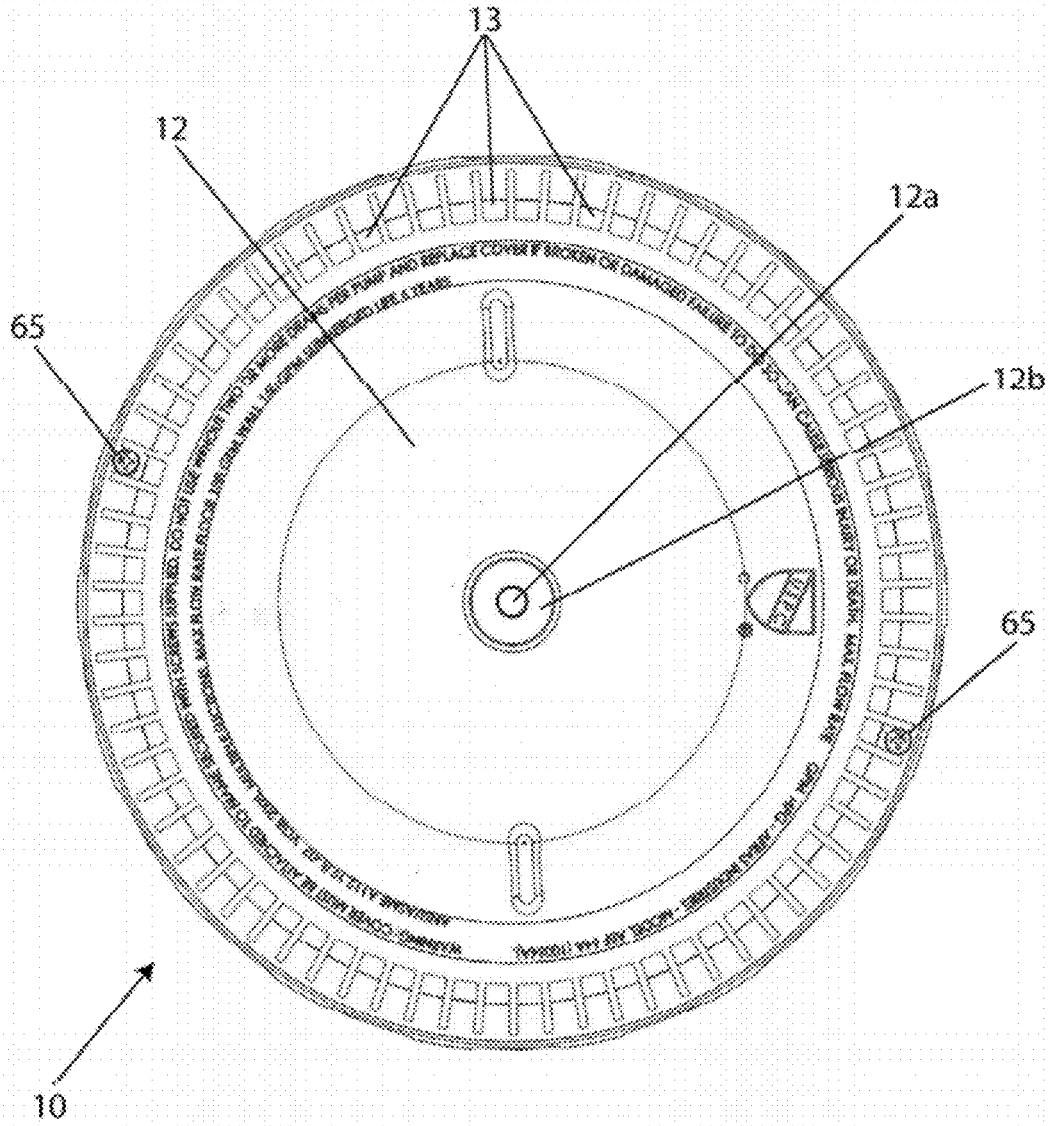
FIG. 3*a* is a top view of the drain cover of the present invention.
Figure 3B:
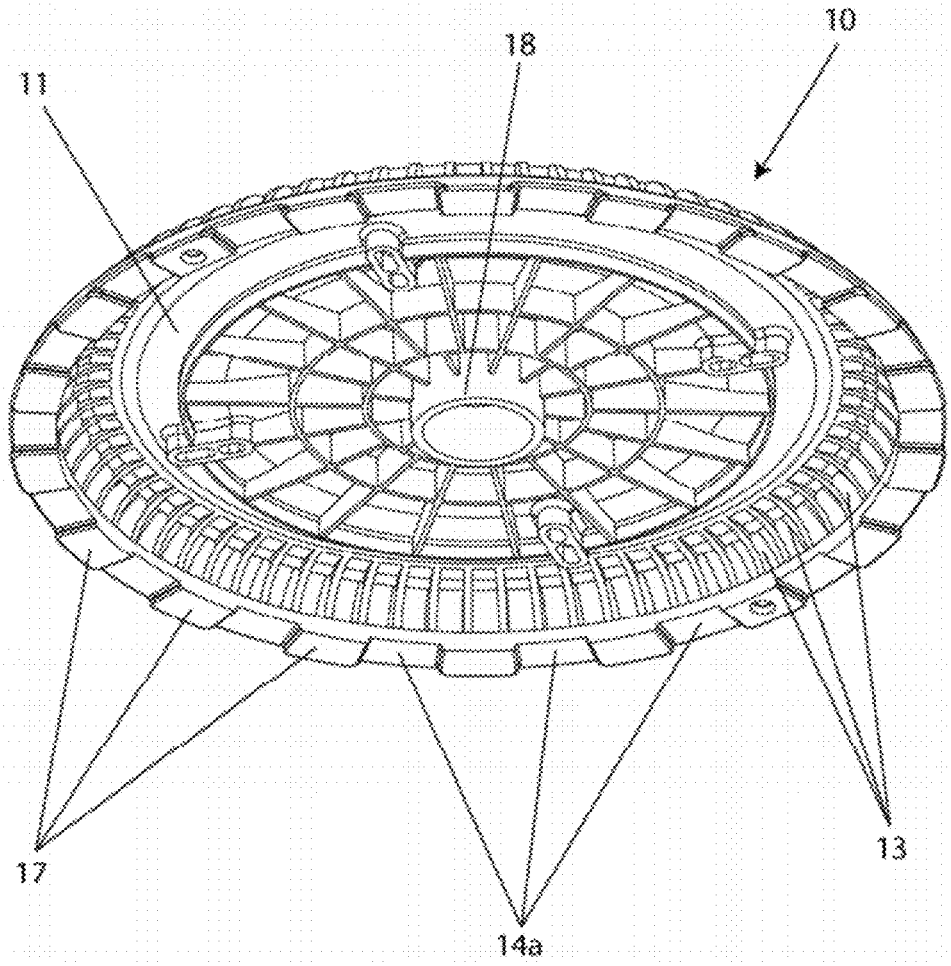
FIG. 3*b* is a bottom perspective view of the drain cover of the present invention.
Figure 4A:
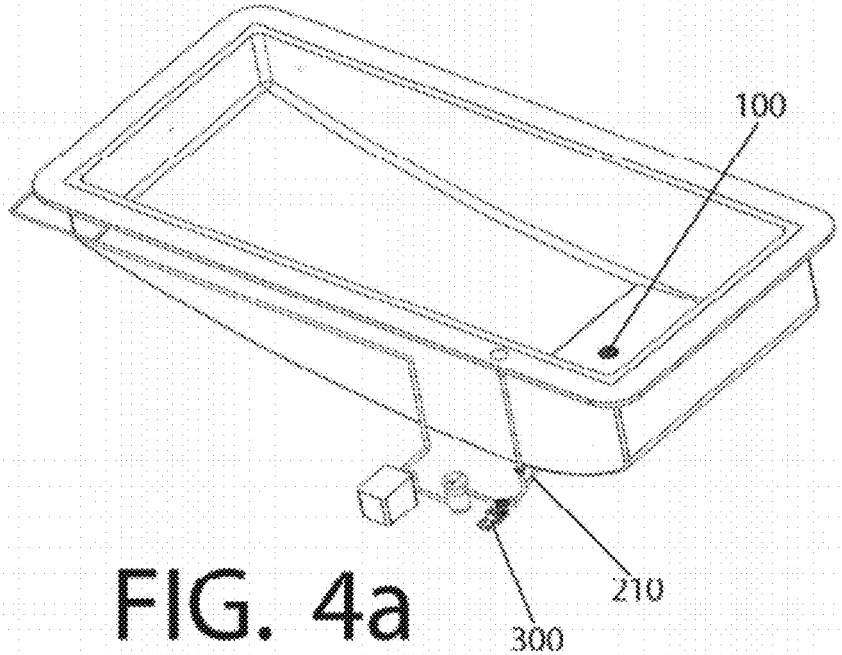
FIGS. 4*a* and 4*b* show diagrams of the recirculation system in a typical swimming pool.
Figure 4B:
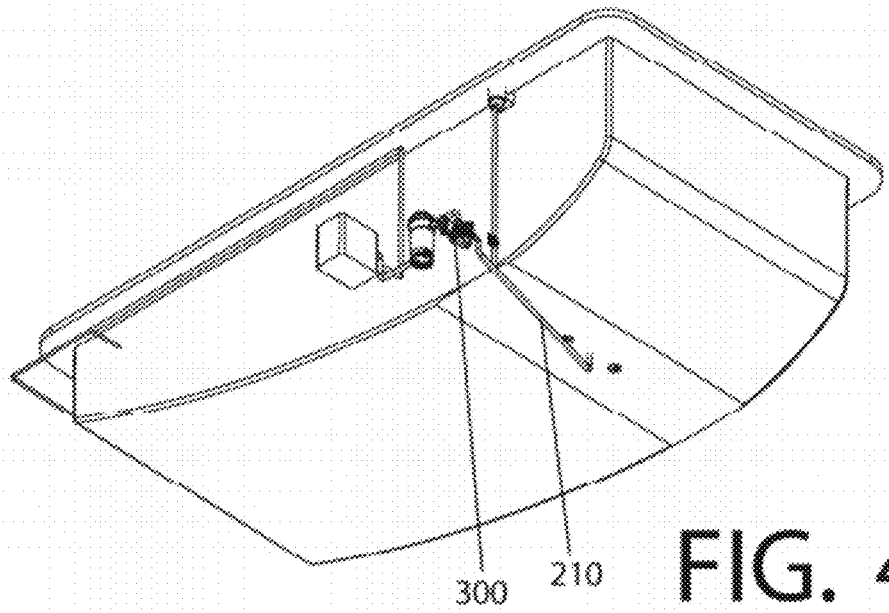

As shown in FIGS. 3*a* and 3*b*, the drain cover 10 has several drain openings 13, 14, and 15 designed to facilitate the extraction of water from the swimming pool at various conditions and under various circumstances. The main drain openings 13 are designed to facilitate the extraction of large volumes of water from the pool under normal operating conditions. As shown in FIG. 4, the drain body 200 is directly connected to the recirculation system of the swimming pool through a pipe 210 that protrudes upward from underneath the swimming pool. The pipe 210 and the drain body 200 are configured to be in fluid communication with the suction side of a suction pump 300 that drives the recirculation system. As the suction pump 300 creates suction pressure within the pipe 210 and drain body 200, the water in the swimming pool is sucked through the main drain openings 13 into the drain body 200 and through the pipe 210.

The main drain openings 13 are located all around the perimeter of the drain cover 10 and designed to be geometrically oriented to minimize the risk of total blockage by a human body. The drain cover 10 is also designed without any small holes or features around which human hair may get entangled. The long hair from the head of a person swimming within the vicinity of the drain apparatus 100 can be sucked in through the main drain openings 13 along with the water and without blocking or restricting the flow of water into the drain body 200. When such an event occurs, the main drain openings 13 and the entire drain apparatus 100 do not have any small holes, protrusions, or features around which the hair may get entangled. All of the surfaces of the drain cover 10 are smooth and without any sharp edges. In other words, the main drain openings 13 are geometrically designed to be wide, long, and positioned in such a manner as to prevent any hair entanglement.

By placing the main drain openings 13 all around the perimeter of the drain cover 10, it requires a body part or piece of clothing to be at least the size of the drain cover 10 to create substantial blockage or restriction of water flow into the drain body 200. For example, a child's forearm or foot would not be large enough to block a substantial number of the main drain openings 13 to create substantial blockage of water flow into the drain body 200.

However, should a substantial number of the main drain openings 13 be blocked, then the suction pressure from the suction pump 300 will continue to suck water into the drain body 200 through the bottom drain openings 14. The bottom drain openings 14 are created by various recesses 14*a* located all around the bottom edge of the drain cover 10, as shown in FIG. 3*b*. When the drain cover 10 is properly attached to the mounting plate 50, the bottom edge of the drain cover 10 is pressed against the top surface 51 of the mounting plate 50 for stability and positioning of the drain cover 10. The multiple recesses 14*a* all around the bottom edge of the drain cover 10 form significant gaps or spaces between the drain cover 10 and the mounting plate 50 that create the bottom drain openings 14. Thus, the bottom drain openings 14 are designed to suck water from the swimming pool in a horizontal direction when a substantial amount of the main drain openings 13 are blocked or restricted. Because the bottom drain openings 14 are specifically placed at the bottom edge of the drain cover 10 and in a horizontal direction, they are difficult to be substantially blocked or restricted by a human body. In essence, the bottom drain openings 14 are part of a safety mechanism of the drain cover 10 to prevent the suction forces that can entrap people when the main drain openings 13 are substantially blocked or restricted.

The mounting plate 50 is attached to the wall or floor of the swimming pool and to the top of the drain body 200 and directly underneath the drain cover 10. A typical drain body 200 has a large top opening 201 to accommodate the 5 to 8 inch drain cover 10 and a smaller bottom opening 202 that is attached to a 1 to 2 inch pipe 210 used in the recirculation system and that is in fluid communication with the suction side of the suction pump 300. The amount of suction force exerted by the suction pump 300 through the drain cover 10 is largely depended on the diameter of the pipe 210 rather than the size of the top opening 201 of the drain body 200. Therefore, the size of the top opening 201 of the drain body 200 can be reduced to be slightly greater than the diameter of the pipe 210 without significantly affecting the suction pressure of the recirculation system. By the same logic, reducing the size of the drain cover 10 to the diameter of the pipe 210 would not significantly affect the suction pressure of the recirculation system in the pool. However, reducing the size of the drain cover 10 significantly increases the probability that the drain cover 10 will be substantially blocked or restricted thus exacerbating the danger of body entrapment.

The mounting plate 50 in the present invention attaches to the wall or floor of the swimming pool and to the top of the drain body 200 and has a drain orifice 51 that effectively reduces the size of the top opening 201 of the drain body 200 to a fixed size that is greater than the diameter of the pipe 210. In essence, the drain apparatus 100 of the present invention reduces the top opening 201 of the drain body 200 without affecting the suction force of the recirculation system and maintains the size of the drain cover 10 at 5 to 8 inches so as not to increase the danger of body entrapment.

It is important for the mounting plate 50 of the present invention to reduce the drain orifice 51 to a fixed size because the plunger 20 that is attached to the drain cover 10 is used as a means to seal the drain orifice 51 to eliminate the suction or vacuum pressure that causes entrapment when the drain cover 10 is substantially blocked or restricted. Therefore, the plunger 20 and the drain orifice 51 in the mounting plate 50 must match in size and shape to create an effective seal of the drain orifice 51 upon a potential entrapment incident. Without a mounting plate 50 having a drain orifice 51 with a fixed diameter, the drain apparatus 100 of the present invention would have to be manufactured and sold with plungers 20 of various sizes to match the multitude drain body 200 sizes currently sold in the marketplace. Even then, the plungers 20 may not create a proper blockage of the top opening 201 of the various drain bodies 200.

Figure 5A:
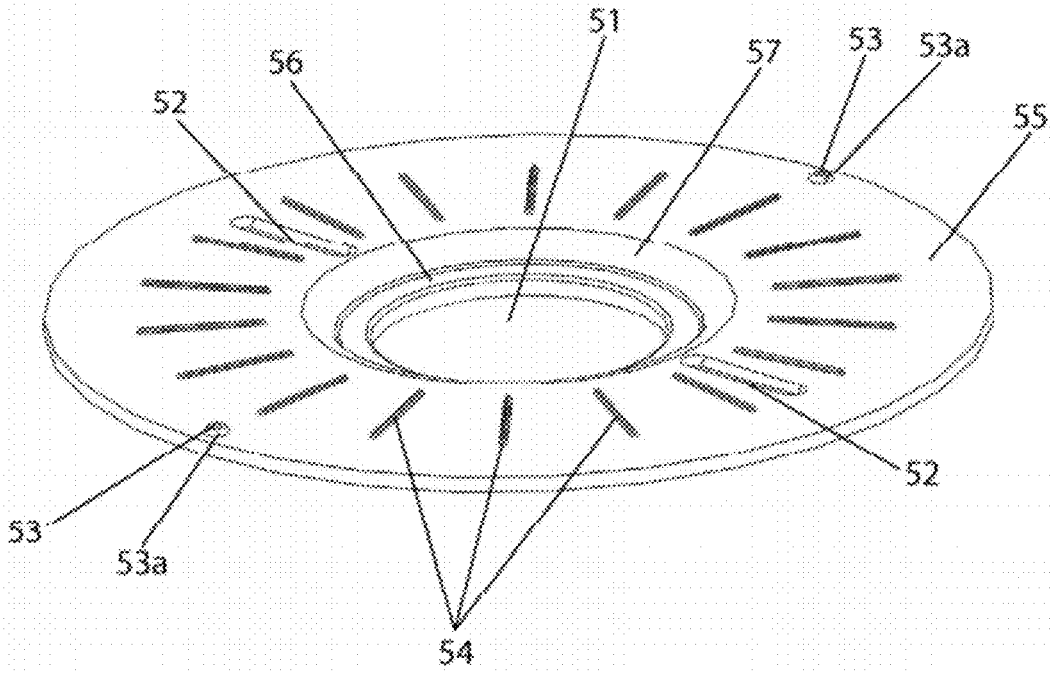
FIG. 5*a* is a perspective view of the mounting plate of the present invention.
Figure 5B:
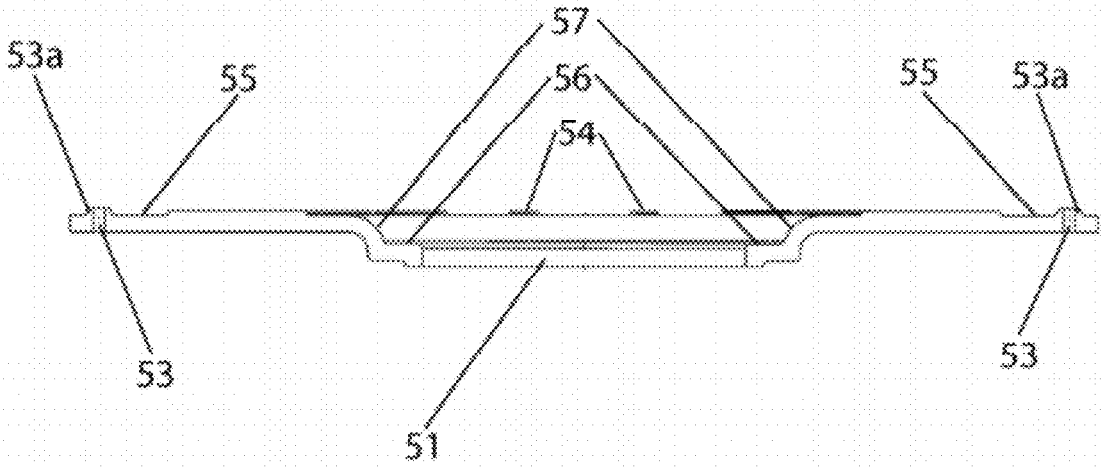
FIG. 5*b* is a cross sectional view of the mounting plate of the present invention.

In essence, the mounting plate 50 of the present invention is a flat plate with a drain orifice 51 at the center, as shown in FIG. 5*a*. Two small holes 52 in the mounting plate 50 are used for two mounting plate screws 60 as means to secure the mounting plate 50 to the wall or floor of the swimming pool and to the top of the drain body 200. Two other small holes 53 with bosses 53*a* protruding from the top surface 55 of the mounting plate 50 are used for two drain cover screws 65 as means to secure the drain cover 10 to the mounting plate 50. In the preferred embodiment of the present invention, multiple small ribs 54 protrude from the top surface 55 of the mounting plate 50 to direct the flow of water into the drain orifice 51 as the water is sucked by the suction pump 300 in the recirculation system. Finally, in the preferred embodiment of the present invention, the drain orifice 51 is created through a circular recess 56 located at the center of the mounting plate 50. The circular recess 56 is created with a sidewall 57 that is angled inward, as shown in FIG. 5*b*, so as to funnel or direct the plunger 20 to the drain orifice 51 when it is pulled downward to the bottom position for blockage or sealing means. The bottom side 22 of the plunger 20 is pushed against the circular recess 56 in the mounting plate 50 to block or seal the drain orifice 51. However, it should be noted that the ribs 54 and the circular recess 56 are not necessary features of the mounting plate 50 of the present invention. A mounting plate 50 that is completely flat without any ribs 54 or circular recess 56 will also function effectively to block or seal the drain orifice 51.

Figure 6:
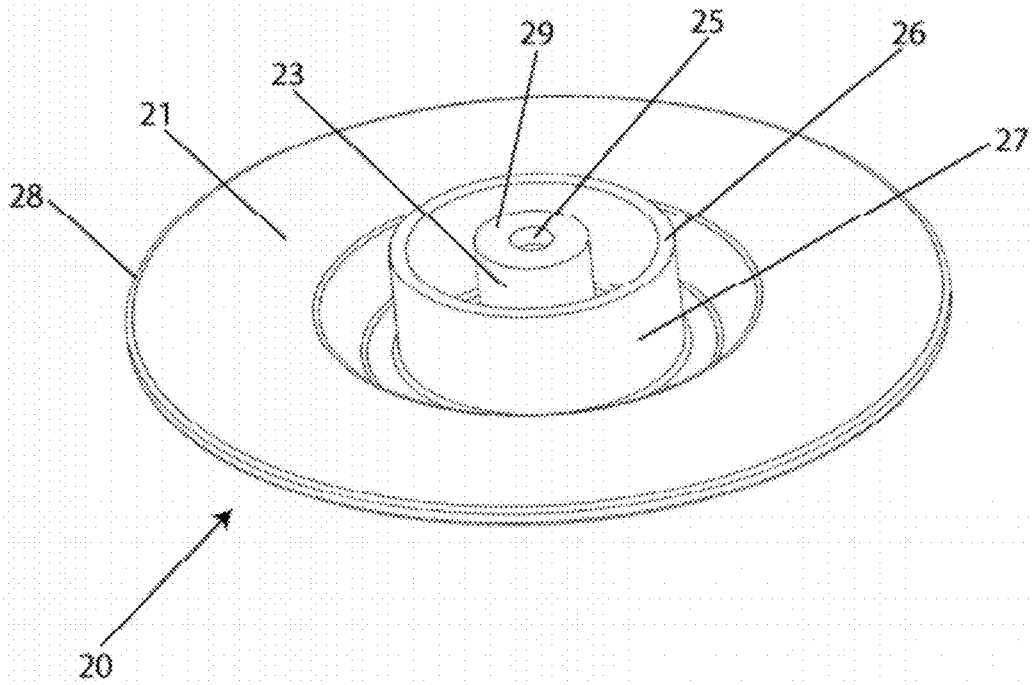
FIG. 6 is a perspective view of the plunger of the present invention.

As shown in FIG. 6, the plunger 20 of the drain apparatus 100 of the present invention is a relatively flat disc having a top side 21, a bottom side 22, an edge 28, and a tubular stem 23 extending through the center. The tubular stem 23 protrudes upward from the top side 21 of the plunger 20 and downward from the bottom side 22 of the plunger 20. The bottom opening 24 of the tubular stem 23 has a larger diameter than the top opening 25. The top opening 25 is reduced in size by an annular shoulder 29 that protrudes inward at the top of the tubular stem 23. Finally, an annular cup 27 protrudes upward from the top side 21 of the plunger 20 sharing the same center with the plunger 20 and the tubular stem 23. The annular cup 27 is of larger diameter than the tubular stem 23 but has a sidewall that encapsulates the tubular stern 23 and is of greater height than the tubular stem 23.

FIG. 7 shows a cross-sectional view of the plunger 20 slidably attached to the drain cover 10 with the joining member 30, the spring 40, and the nut 35 so that the drain cover 10 can slide in a vertical direction from a top position to a bottom position. The drain cover 10 has a recessed hole 12*a* at its center on the top face 12 through which the joining member 30 is inserted until its head 31 rests on the bottom surface of the recess 12*b*. After the joining member 30 is through the drain cover 10, it is then inserted through the top opening 25 of the tubular stem 23 of the plunger 20. Once the top edge 26 of the annular cup 27 is resting on the bottom surface 11 of the drain cover 10, the joining member 30 extends through the bottom opening 24 of the tubular stem 23. Thereafter the spring 40 is placed over and around the joining member 30 through the bottom opening 24 until it is completely encapsulated within the tubular stem 23 and resting on the shoulder 29 of the tubular stem 23. Finally, the nut 35 is threaded to the joining member 30 until it is past the bottom opening 24 and within the tubular stem 23 and it exerts some compressive force on the spring 40. The biasing force generated by the spring 40 against the shoulder 29 of the tubular stem 23 keeps the plunger 20 in the top position, as shown in FIG. 7.

Once the plunger 20 is assembled to the drain cover 10 with the joining member 30, spring 40, and nut 35, it is held in place at the center of the drain cover 10 and within a second annular cup 18 that protrudes from the bottom surface 11 of the drain cover 10. The inner diameter of the second annular cup 18 on the drain cover 10 is greater than the outer diameter of the annular cup 27 on the plunger 20. When properly positioned, the second annular cup 18 of the drain cover 10 is placed over and around the annular cup 27 of the plunger 20 so that the sidewalls of each annular cups 18, 27 cooperate together to maintain the plunger 20 centered on the drain cover 10 and to keep the joining member 30 in a straight vertical position.

Hereinafter, an explanation on the methods of packaging and distributing the product of the present invention, the installation thereof to a swimming pool drain, and the operating states thereof will be given.

For the distribution of the drain apparatus 100 of the present invention, two major parts, that is the mounting plate 50 and the drain cover 10 pre-assembled with the plunger 20, joining member 30, spring 40, and nut 35, are packaged ready for installation to a swimming pool drain. In addition to the two major parts, two or four mounting plate screws 60 and two or four drain cover screws 65 may be included in the package for convenience and ease of installation.

In order to install the drain apparatus 100 of the present invention, then after the parts of the product are unpackaged, the mounting plate 50 must first be attached using the mounting plate screws 60 to the wall or floor of the swimming pool and to the top of the drain body 200 being used in the swimming pool. Finally, using the drain cover screws 65, the drain cover 10 must be centered and attached directly to the mounting plate 50, thereby finishing the installation process of the drain apparatus 100 according to the present invention. In essence, the drain cover 10 is secured to the wall or floor of the swimming pool so as to prevent the drain cover 10 from moving or being displaced in the vertical direction. The installation of the product of the present invention is simple enough for a typical homeowner to complete without the aid of special tools or a professional.

When the drain apparatus 100 of the present invention is installed on to the wall or floor of a swimming pool, the suction pump 300 of the recirculation system will suck water from the swimming pool through the main drain openings 13 of the drain cover 10, through the drain orifice 51 of the mounting plate 50 and through the pipe 210. Under normal operating conditions, the plunger 20 will remain in the top position pushed against the bottom surface 11 of the drain cover 10 by the biasing force exerted by the spring 40 against the shoulder 29 of the tubular stem 23 of the plunger 20 and against the nut 35. As the plunger 20 is held against the drain cover 10 by the biasing force generated by the spring 40, the top edge 26 of the annular cup 27 of the plunger 20 is pressed against the bottom surface 11 of the drain cover 10 with sufficient force to create a seal that minimizes the flow of water out of the annular cup 27. The center drain openings 15 of the drain cover 10 are closely clustered together in the center of the drain cover 10 and within the annular cup 27. Therefore, under normal operating conditions, as the water is sucked through the main drain openings 13 and even through the bottom drain openings 14, the pressure of the top edge 26 of the annular cup 27 of the plunger 20 against the bottom face 11 of the drain cover 10 prevents or significantly reduces the suction of water through the center drain openings 15.

A small cap 16, preferably circular in shape, is either attached or molded on to the center of the top face 12 of the drain cover 10. The diameter of the small cap 16 is smaller than the inner diameter of the annular cup 27 of the plunger 20. In addition, the small cap 16 protrudes upward from the top face 12 of the drain cover 10 with a vertical sidewall 16*b* having various small holes that are the center drain openings 15 of the drain cover 10. Therefore, the center drain openings 15 allow water from the pool to flow into the annular cup 27 of the plunger 20. This flow of water into the annular cup 27 of the plunger is mostly driven by gravity since, under normal operating conditions, the top edge 26 of the annular cup 27 seals against the bottom surface 11 of the drain cover 10 preventing the suction force from the recirculation system from sucking water through the center drain openings 15.

Figure 8A:
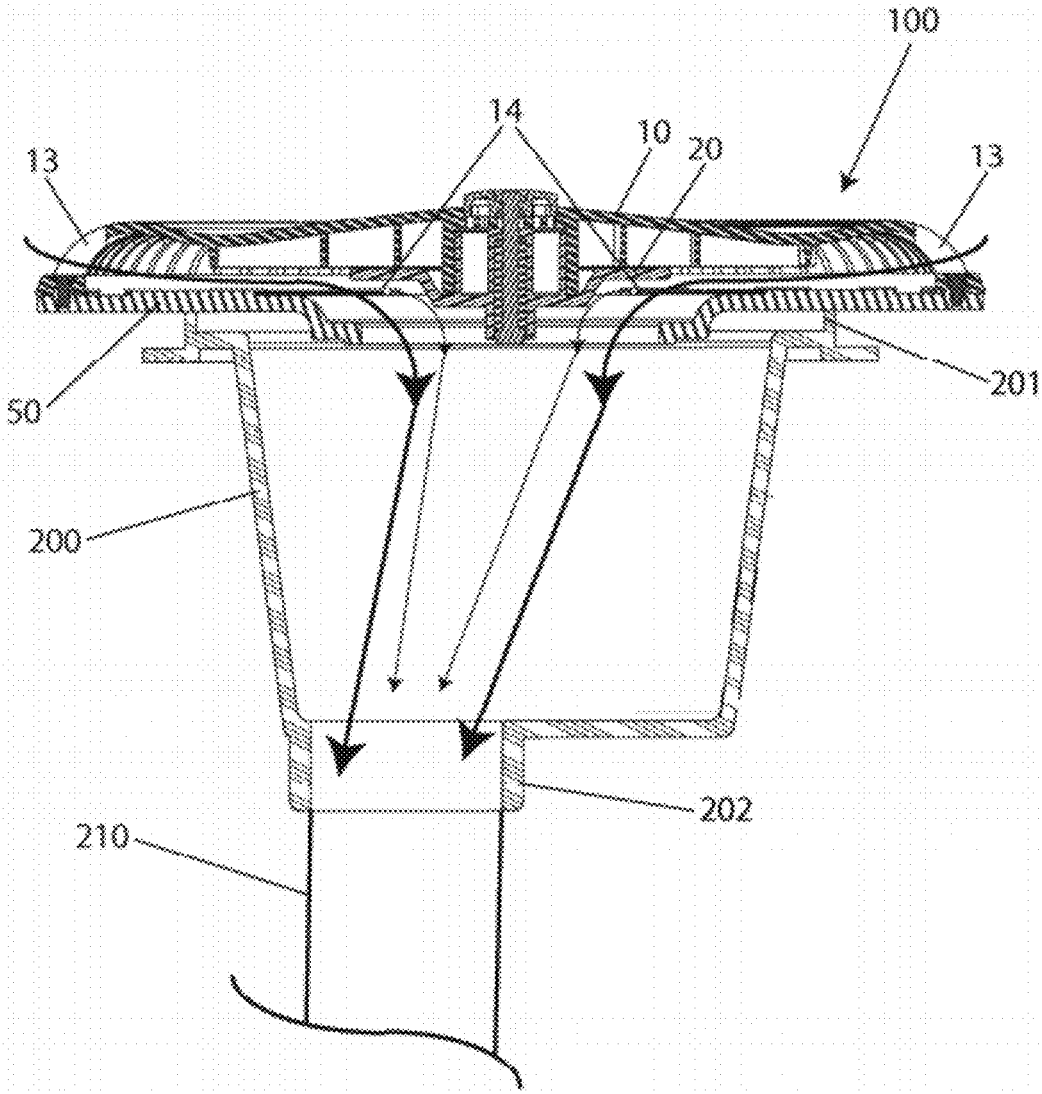
FIG. 8*a* is a cross sectional view of the drain apparatus of the present invention under normal operating conditions with the plunger in the top position and the flow of water represented by the arrows.
Figure 8B:
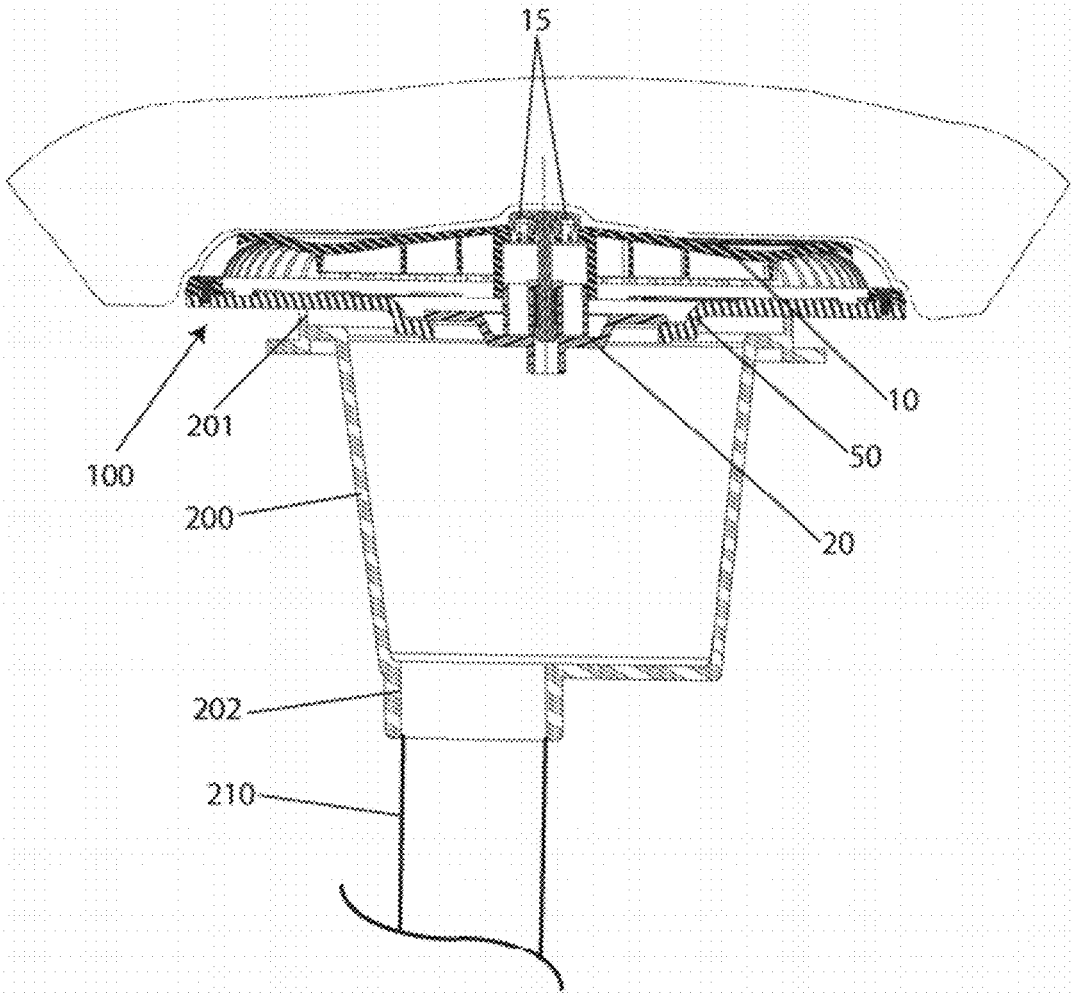
FIG. 8*b* is a cross sectional view of the drain apparatus of the present invention when the drain cover is substantially blocked or covered, as represented by the dotted line, and the plunger is in the bottom position to block or seal the drain orifice of the mounting plate.

FIG. 8*a* shows the position of the plunger 20 and flow of the water, represented by the arrows, under normal operating conditions. On the other hand, FIG. 8*b* shows the position of the plunger 20 when a blockage or entrapment incident occurs at the drain cover 10, as shown by the dotted line. During a blockage or entrapment incident, all or a substantial number of the main drain openings 13 and bottom drain openings 14 of the drain cover 10 are blocked or restricted. Such blockage creates a large vacuum or downward suction force underneath the drain cover 10 that can entrap a person or pull down anything in the vicinity of the drain cover 10. The large suction force is sufficient to overcome the resistance of the spring 40 thus pulling the plunger 20 downward to the bottom position until the bottom side 22 of the plunger 20 is forced against the circular recess 56 in the mounting plate 50 as means to block or seal the drain orifice 51 of the mounting plate 50. Upon blocking the drain orifice 51, the large vacuum or suction pressure at the drain cover 10 is eliminated allowing the entrapped person to be released instantly.

As the plunger 20 is pulled downward to the bottom position to block or seal the drain orifice 51, the sidewall of the second annular cup 18 of the drain cover 10 cooperates with the sidewall of the annular cup 27 of the plunger 20 to ensure that the plunger 20 is displaced in a straight vertical direction without any wobbling. Furthermore, as the plunger 20 nears the drain orifice 51, the sidewall 57 that is angled inward as part of the circular recess 56 on the mounting plate 50 cooperates with the edge 28 of the plunger 20 to funnel or direct the plunger 20 to the drain orifice 51.

On some occasions, when the vacuum or suction force underneath the drain cover 10 approach a dangerous level, the plunger 20 may have a tendency to vacillate between the top and bottom position. The center drain openings 15 on the drain cover 10 solve this problem by allowing a small amount of water to be sucked into the annular cup 27 of the plunger 20 during an entrapment incident, thus adding to the downward force of the plunger 20 to exceed the resistance of the spring 40 by a substantial margin.

As shown in FIG. 8*b*, when a large body part blocks or restricts a substantial number of the main drain openings 13 and bottom drain openings 14, the center drain openings 15 are very difficult to also be blocked due to their location and arrangement on the drain cover 10. The center drain openings 15 are located in the vertical sidewall of the small cap 16 having a small diameter and protruding from the top surface 11 of the drain cover 10. Due to the size of the small cap 16, its sidewall is very difficult to be completely blocked when the rest of the drain cover 10 is blocked. In addition, the lack of any suction force through the center drain openings 15 during normal operating conditions make them even less likely to be blocked. In fact, when the drain cover 10 is blocked be a human body, the sidewall of the small cap 16 will most likely be unrestricted and within a small pocket of water that is trapped between the human body and the drain cover 10. When the large vacuum or suction force pulls and displaces the plunger 10 downward, it breaks the seal between the top edge 26 of the annular cup 27 of the plunger 20 and the bottom face 11 of the drain cover 10. With this seal broken, the water in the small pocket between the human body and the drain cover 10 is sucked through the center drain openings 15 and adds to the downward force against the plunger 10. This force coupled with the suction force from the recirculation system is sufficient to overcome the resistance of the spring 40 with a substantial margin and drive the plunger 20 down until it pushes against the mounting cover 50 to seal or block the drain orifice 51.

Once the drain orifice 51 is blocked by the plunger 20, it eliminates any vacuum or suction force at and underneath the drain cover 10 and allows the entrapped person to be released with ease. However, once the drain orifice 51 is blocked by the plunger 20 and the entrapped person is released, the plunger 20 does not return upward to its original position to unblock the drain orifice 51 until the suction pump 300 in the recirculation system is actually turned off. In other words, the only way to unblock the drain orifice 51 and return the drain apparatus 100 to normal operating condition after an entrapment incident is to turn off or cut power to the suction pump 300.

Since the drain apparatus 100 of the present invention is very effective in instantly releasing an entrapped person at the drain cover 10 of a swimming pool, the person may never realize that he/she was entrapped for a split second before the drain orifice 51 was blocked by the plunger 20. Thus, the person may not realize that the drain orifice 51 is blocked by the plunger 20 and the suction pump 300 is sucking air rather than water. The person may not realize that the suction pump 300 must be turned off to return the drain apparatus 100 of the present invention to normal operating position. A long delay in turning off the suction pump 300 may cause damage to the suction pump 300 due to overheating by lack of water flow.

Figure 9:
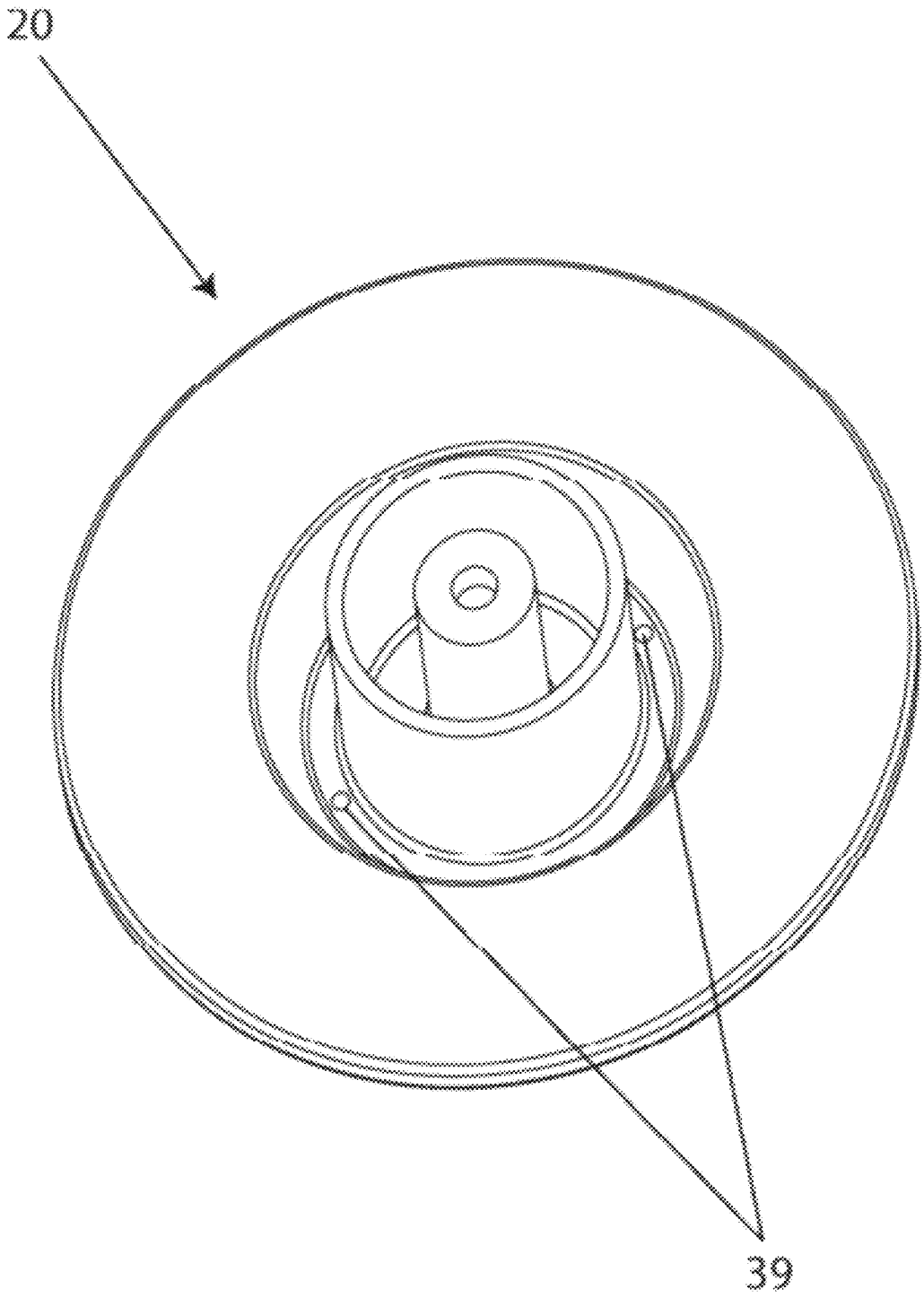
FIG. 9 shows the plunger with the additional small holes according to an alternative embodiment of the present invention.

To delay and reduce damage to the suction pump 300 when the drain orifice 51 is blocked by the plunger 20, small holes 39 can be placed on the plunger 20, as shown in FIG. 9, to allow a small amount of water to be sucked into the pipe 210 and to the suction pump 300 for cooling after the entrapped body or object is removed from the drain cover 10. Once the drain cover 10 is cleared of any entrapped body or object, the drain openings 13, 14, 15 will be unblocked. Thus gravity will allow water to flow into the drain body 200. However, since the plunger 20 is blocking the drain orifice 51, the water will not flow into the pipe 210 as it would under normal operating conditions. Instead the pipe 210 will continue to be filled with air that is being sucked by the suction pump 300 instead of water. But if small holes 39 are placed on the plunger 20, small amounts of water will flow into the pipe 210 and to the suction pump 300 for some cooling and delay of any damage to the pump 300.

In placing the small holes 39, much care must be given to their size and quantity. The size and quantity of the small holes 39 can adversely affect the ability of the plunger 20 to effectively block the drain orifice 51 during an entrapment incident. Although the small holes 39 are not used in the preferred embodiment, they can be effectively included in an alternative embodiment to prolong the life of the suction pump 300. But it is the opinion of the inventor that care must be taken in designing the small holes 39 since a person's life is far more important than the life of the suction pump 300.

An alternative embodiment of the drain apparatus 100 of the present invention has the plunger 20 attached to the mounting plate 50 rather than the drain cover 10. The mounting plate 50 would have a structure directly over the drain'orifice 51 that would hold the plunger 20 in the top position. The plunger 20 would be assembled to the structure on the mounting plate 50 with the joining element 30, spring 40, and nut 35 much as in the preferred embodiment. The functionality of the plunger 20 and the entire drain apparatus 100 would still be the same as in the preferred embodiment.

Another alternative embodiment of the drain apparatus 100 of the present invention does not have the mounting plate 50. Instead, the drain cover 10 with the plunger 20 assembled in the top position as described in the preferred embodiment is installed to a wall or floor of the swimming pool and directly over the pipe 210 that is in fluid communication with the suction side of the suction pump 300. In essence, the swimming pool does not have a drain body 200. Instead the swimming pool only has a pipe 210 that terminates with an open end at the wall or floor of the swimming pool. The open end of the pipe 210 serves as the drain orifice 51. The drain cover 10 is attached directly over the open end of the pipe 210 and the plunger 20 serves to block or seal the open end of the pipe 210 during an entrapment incident. Since the swimming pool does not have a drain body 200, a mounting plate 50 is not required. Instead, the plunger 20 blocks or seals the pipe 210 directly in a similar manner as in the preferred embodiment. Otherwise, the functionality of the drain apparatus 100 is the same as in the preferred embodiment.

Yet another alternative embodiment of the drain apparatus 100 of the present invention has the plunger 20 attached directly to the open end of the pipe 210 that is in fluid communication with the suction side of the suction pump 300. Otherwise, the plunger 20 is still spring biased and the functionality of the plunger 20 and the drain apparatus 100 is the same as in the preferred embodiment. The drain orifice 51 in this embodiment is the open end of the pipe 210. The plunger 20 is attached to a coupling or some structure that is then attached directly to the open end of the pipe 210. As in the preferred embodiment, the plunger 20 is attached to the coupling or structure in the top position.

It is understood that the described embodiments of the present invention are illustrative only, and that modifications thereof may occur to those skilled in the art. Accordingly, this invention is not to be regarded as limited to the embodiments disclosed, but to be limited only as defined by the appended claims herein.

What is claimed is:

1. A drain apparatus for installation in a swimming pool, a spa, or any large container of water comprising:

a drain orifice that is in fluid communication with a suction pump for draining water from said swimming pool, spa, or any large container of water;

a drain cover immovably secured adjacent a surface of said swimming pool, spa, or any large container of water so as to prevent any vertical displacement of said drain cover and having a plurality of drain openings through which water from said swimming pool, spa, or any large container of water is drained by said suction pump;

sealing means slidably attached to said drain cover for opening said drain orifice when said sealing means is disposed in a top position and closing said drain orifice when said sealing means is disposed in a bottom position, such that a vacuum underneath said drain cover is eliminated when said sealing means is in said bottom position; and means for biasing said sealing means toward said top position such that said drain orifice is normally open, but when a maximum allowed vacuum level is exceeded, said biasing means enables said sealing means to slide toward said bottom position without any vertical displacement of said drain cover.

2. The drain apparatus Of claim 1 wherein said sealing means comprises a plunger.

3. The drain apparatus of claim 1 wherein said means for biasing comprises a spring.

4. The drain apparatus of claim 1 wherein said plurality of drain openings are geometrically oriented to minimize the risk of total blockage by a human body.

5. The drain apparatus of claim 1 wherein said plurality of drain openings, sealing means, and means for biasing are geometrically designed and positioned to prevent hair entrapment.

6. The drain apparatus of claim 1 further comprising a means for guiding said sealing means in a straight vertical direction as said sealing means is displaced from said top position to said bottom position so that said sealing means closes said drain orifice.

7. The drain apparatus of claim 1 wherein said drain cover further comprises a plurality of center drain openings through which water is drawn to facilitate said sealing means to move toward said bottom position when a maximum allowed vacuum level underneath said drain cover is exceeded.

8. The drain apparatus of claim 1 wherein said sealing means further comprises a plurality of small holes that allow some water to flow to said suction pump when said sealing means is disposed in said bottom position.

9. A drain apparatus for installation in a swimming pool, a spa, or any large container of water comprising:

a mounting plate having a drain orifice that is in fluid communication with a suction pump for draining water from said swimming pool, spa, or any large container of water;

means for securing said mounting plate adjacent a surface of said swimming pool, spa, or any large container of water;

a drain cover having a bottom face and a plurality of drain openings through which water from said swimming pool, spa, or any large container of water is drained by said suction pump;

means for immovably securing said drain cover to said mounting plate so as to prevent any vertical displacement of said drain cover;

a plunger slidably attached to said bottom face of said drain cover in a top position to maintain said drain orifice of said mounting plate open and closing said drain orifice of said mounting plate when said plunger is disposed in a bottom position, such that a vacuum underneath said drain cover is eliminated when said plunger is in said bottom position; and means for biasing said plunger toward said top position such that said drain orifice of said mounting plate is normally open, but when a maximum allowed vacuum level is exceeded, said biasing means enables said plunger to slide toward said bottom position without any vertical displacement of said drain cover.

10. The drain apparatus of claim 9 wherein said means for biasing comprises a spring.

11. The drain apparatus of claim 9 wherein said means for securing comprises screws.

12. The drain apparatus of claim 9 wherein said plurality of drain openings are geometrically oriented to minimize the risk of total blockage by a human body.

13. The drain apparatus of claim 9 wherein said plurality of drain openings, sealing means, and means for biasing are geometrically designed and positioned to prevent hair entrapment.

14. The drain apparatus of claim 9 wherein said drain cover further comprises means for guiding said plunger in a straight vertical direction while encapsulating said means for biasing said plunger as said plunger is displaced from said top position to said bottom position so that said plunger closes said drain orifice.

15. The drain apparatus of claim 9 wherein said drain cover further comprises a plurality of center drain openings through which water is drawn to facilitate said plunger to move toward said bottom position when a maximum allowed vacuum level underneath said drain cover is exceeded.

16. The drain apparatus of claim 9 wherein said plunger further comprises a plurality, of small holes that allow a small amount of water to drain to said suction pump for cooling and lubrication when said plunger is in the bottom position.

17. The drain apparatus of claim 9 wherein said plunger further comprises a plurality of small holes that allow some water to flow to said suction pump when said plunger is disposed in said bottom position.

18. A drain apparatus for installation in a swimming pool, a spa, or any large container of water comprising:

a drain orifice in a surface of said swimming pool, spa, or any large container of water that is in fluid communication with a suction pump for draining water from said swimming pool, spa, or any large container of water;

a drain cover having a plurality of drain openings through which water from said swimming pool, spa, or any large container of water is drained by said suction pump;

means for immovably securing said drain cover over said drain orifice and adjacent said surface of said swimming pool, spa, or any large container of water so as to prevent any vertical displacement of said drain cover;

a plunger slidably attached to said drain cover in a top position to maintain said drain orifice open and closing said drain orifice when said plunger is disposed in a bottom position, such that a vacuum underneath said drain cover is eliminated when said plunger is in said bottom position; and means for biasing said plunger toward said top position such that said drain orifice is normally open, but when a maximum allowed vacuum level is exceeded, said biasing means enables said plunger to slide toward said bottom position without any vertical displacement of said drain cover.

19. The drain apparatus of claim 18 wherein said means for biasing comprises a spring.

20. The drain apparatus of claim 18 wherein said means for securing comprises screws.

21. The drain apparatus of claim 18 wherein said plurality of drain openings are geometrically oriented to minimize the risk of total blockage by a human body.

22. The drain apparatus of claim 18 wherein said plurality of drain openings, sealing means, and means for biasing are geometrically designed and positioned to prevent hair entrapment.

23. The drain apparatus of claim 18 wherein said drain cover further comprises means for guiding said plunger in a straight vertical direction while encapsulating said means for biasing said plunger as said plunger is displaced from said top position to said bottom position so that said plunger closes said drain orifice.

24. The drain apparatus of claim 18 wherein said drain cover further comprises a plurality of center drain openings through which water is drawn to facilitate said plunger to move toward said bottom position when a maximum allowed vacuum level underneath said drain cover is exceeded.

25. The drain apparatus of claim 18 wherein said plunger further comprises a plurality of small holes that allow a small amount of water to drain to said suction pump for cooling and lubrication when said plunger is in the bottom position.

26. The drain apparatus of claim 18 wherein said plunger further comprises a plurality of small holes that allow some water to flow to said suction pump when said plunger is disposed in said bottom position.

* * * * *